US007861835B2

(12) United States Patent
Montross

(10) Patent No.: US 7,861,835 B2
(45) Date of Patent: Jan. 4, 2011

(54) DISPOSABLE LUGGAGE WRAP

(76) Inventor: S. Sam Montross, 2805 E. Oakland Park Blvd., #217, Ft. Lauderdale, FL (US) 33306

( * ) Notice: Subject to any disclaimer, the term of this patent is extended or adjusted under 35 U.S.C. 154(b) by 477 days.

(21) Appl. No.: 11/797,376

(22) Filed: May 3, 2007

(65) Prior Publication Data

US 2008/0088125 A1 Apr. 17, 2008

Related U.S. Application Data

(60) Provisional application No. 60/851,076, filed on Oct. 12, 2006.

(51) Int. Cl.
*A45C 13/20* (2006.01)
*G09F 3/08* (2006.01)

(52) U.S. Cl. ..... 190/101; 190/26; 190/102; 40/6; 283/80

(58) Field of Classification Search ..... 190/25, 190/26, 100–102, 103; 40/6, 638; 283/80; 292/370 B, 307 B
See application file for complete search history.

(56) References Cited

U.S. PATENT DOCUMENTS 2,484,951 A * 10/1949 Kubo ..... 280/38
3,231,992 A * 2/1966 Swett ..... 40/665
3,407,927 A * 10/1968 Jones ..... 206/372
3,429,065 A * 2/1969 Long et al. ..... 40/662
3,729,038 A * 4/1973 Ekeson ..... 190/110
3,752,312 A * 8/1973 Soltanoff ..... 209/3.3
3,996,719 A * 12/1976 Dabrowski et al. ..... 53/399
4,065,343 A * 12/1977 Stumpe ..... 156/212
4,856,570 A * 8/1989 Rushing et al. ..... 150/107
5,318,817 A * 6/1994 Ohno et al. ..... 40/665
5,451,282 A * 9/1995 Fore ..... 156/212
5,560,657 A * 10/1996 Morgan ..... 283/80
6,304,183 B1 * 10/2001 Causey ..... 340/572.1
6,364,365 B1 * 4/2002 Caplan ..... 283/80
6,766,039 B1 * 7/2004 Al-Sheikh ..... 382/115
2004/0206431 A1 * 10/2004 Metzig et al. ..... 150/154
2005/0179548 A1 * 8/2005 Kittel et al. ..... 340/568.2
2005/0242962 A1 * 11/2005 Lind et al. ..... 340/572.8
2006/0225332 A1 * 10/2006 Zenisek ..... 40/638
2008/0257673 A1 * 10/2008 Mrocki et al. ..... 190/101
2009/0031594 A1 * 2/2009 Kosmin ..... 40/6
2009/0194210 A1 * 8/2009 Montross ..... 150/154

FOREIGN PATENT DOCUMENTS

GB 2278779 A * 12/1994
WO WO 2006096908 A1 * 9/2006
WO WO 2006123952 A1 * 11/2006

* cited by examiner

*Primary Examiner*—Sue A Weaver
(74) *Attorney, Agent, or Firm*—Sean L. Ingram, Esq.

(57) ABSTRACT

A disposable strip of non-elastic, tear resistant luggage wrap material is provided that extends around the outer periphery of a piece of luggage and adhesively secures to itself. A plurality of disposable strips may be coupled end-to-end to accommodate large luggage pieces. The disposable strip may be removed by tearing along a plurality of spaced, inline apertures. The disposable strip includes several features, such as indicia that identify luggage as belonging to a group, organization or commercial carrier. The disposable strip also may include a security portion having an area for receiving the user's signature or initials to inhibit unauthorized tampering. A pocket may be provided on the disposable strip to receive user identification, a travel itinerary or other document. Furthermore, the disposable strip may be configured to receive an R.F.I.D. tag for electronic tracking.

18 Claims, 2 Drawing Sheets

DISPOSABLE LUGGAGE WRAP

CROSS-REFERENCE TO RELATED TOPICS

This application claims priority to U.S. provisional patent application No. 60/851,076 filed Oct. 12, 2006.

STATEMENT REGARDING FEDERALLY SPONSORED RESEARCH OR DEVELOPMENT

Not Applicable

REFERENCE TO SEQUENCE LISTING A TABLE, OR A COMPUTER PROGRAM LISTING COMPACT DISK APPENDIX

Not Applicable

BACKGROUND OF THE INVENTION

Two million people pass through airports daily. With the demands on Security after September 9/11, new regulations have been imposed on the traveler. One demand requires luggage to be openable for inspection by security personnel, leaving travelers with less secure luggage while in transit. This new regulation has not only increased the burden on travelers, but on the carriers, hotels, luggage handlers, and the entire system. When luggage is compromised, because luggage is not locked, it is more difficult to fend off responsibility for theft claims, even when a carrier may not have been the party holding or handling the bags when the violation occurred.

The luggage industry has been successful in standardizing luggage to selected sizes, shapes and color. As a result, most luggage looks very similar, and the traveler must locate their luggage with the aid of small I.D. (identification) tags, attached to the luggage with string or straps. Unfortunately, these I.D. tags may be torn from the luggage during transit. Travelers have also been warned about placing too much I.D. information on a tag for fear a potential vandal will learn where they live. Some people are hesitant to use I.D. tags containing personal information. The identification tags are often difficult to read from a distance, or while the luggage is in route on a conveyor, resulting in confusion, mistakes, time delays, and lost and misappropriated luggage. In August 2006, the rate of mishandled bags rose to 8.08 per 1,000 passengers, according to airconsumer.ost.dot.gov. Since August 2006, when domestic airlines dramatically restricted what could be carried on board, the number of checked bags has soared. According to numbers released by the U.S. Department of Transportation in September 2006, some 183, 234 bags were mishandled, up 92 percent from the year before. Globally, about 30 million bags go astray every year, of which around 200,000 are never reunited with their owners.

With 11 million people traveling on cruises annually, the cruise line or passenger carrier has to be able to quickly identify the luggage at the airport for the passengers riding thereon. They also have to be sure that, at the shipping ports, airports, and terminals, the luggage gets onto the correct carrier. One missed bag will not rejoin the passenger until their cruise is over. This can be very upsetting to the traveler. The I.D. tags can be torn off, while labels adhesively attached to the luggage leave a residue on the luggage fabric, which is not acceptable to many travelers.

The use of an electronic system for tracking and storing bags is the way of the future, and one system already gaining popularity is with the use of R.F.I.D. (radio frequency identification) tags, sometimes called sensors. R.F.I.D. tags may be built into new products, but the ability to safely attach the R.F.I.D. tags to existing travel luggage is a challenge, solved by this invention.

U.S. Pat. No. 6,364,365 and PCT WO 00/70587 issuing to Frances J. Caplan, discloses the use of labels and tags which include distinctive patterns or a combination of patterns which are attached to luggage with adhesive, string or straps to aid identification. The adhesive can leave residue on the luggage fabric, while the string or straps may be torn off during transit.

U.S. Patent Application Publication 2006/0144661 by Lucia Louise Burns, discloses a luggage hugger made of stretchable fabric forming a continuous band about the luggage. The luggage hugger is easily removable and replaceable about the luggage during transport.

U.S. Pat. No. 6,430,974 issuing to Tommie L. Mitchell and Juanita Mitchell discloses an elastic strap and lock with ring assemblies for luggage, wherein the strap may be placed beneath the luggage handle. The strap includes a plurality of holes through the elastic strap to adjust the size of the strap to fit the luggage.

U.S. Pat. No. 5,510,768 issuing to Glenn E. Mann discloses an alarm strap for luggage, which emits an audible alarm when the alarm strap is broken.

U.S. Pat. No. 5,451,282 issuing to John C. Fore discloses an inelastic plastic tape which is wrapped around the lock on the luggage. The tape adheres to itself and to the luggage over the entire length of the tape, leaving an adhesive residue on the luggage, when the tape is removed.

U.S. Design Pat. 297,248 issuing to Victor M. Barr discloses an identification band for use on luggage and garment bags. The identification band has hook and loop type closure material on opposite ends and opposite sides of the band. The band may be easily removed, the luggage opened, then the band replaced, without subsequent observable detection.

U.S. Pat. No. 4,700,818 issuing to John P. Orwin discloses a pair of straps, which encircle the luggage and pass on either side of the luggage handle. An additional pair of cross straps are secured between the encircling straps to stop the device from being slid or pulled off the luggage. Hook and loop fasteners are used to secure and tighten the encircling straps, which may be removed during transit without subsequent observable detection.

U.S. Pat. No. 4,065,343 issuing to Warren R. Stumpe discloses a label system for package and baggage handling, which has printing on one side and the other side is at least partially coated with an adhesive. The label is affixed to the luggage on three sides for ease of identification. The adhesive is likely to leave an adhesive residue on the luggage after removal of the label, which is tacky.

U.S. Pat. No. 3,955,656 issuing to Albert A. Kashinski discloses an elastic cover and seal for protecting luggage, wherein the elastic cover seals the closure around a substantial portion of the luggage. An opening is provided in the elastic cover to receive the luggage handle therethrough.

U.S. Design Pat. 340,338 issuing to Scott C. Van Buren discloses a removable and reusable golf bag strap having a graphic design positioned thereon. The strap has hook and loop type fasteners on opposing ends and opposing sides to secure the strap to a golf bag.

U.S. Pat. No. 3,752,312 issuing to Louis Soltanoff discloses a label for baggage handling, wherein an encircling belt of heat-shrinkable plastic material is shrunk about the luggage, and a destination identifying indicia is printed on the plastic belt, which may be read by an optical scanner to determine the destination of the baggage. While these inventions provide selected improvements to luggage handling, they do not provide the protection, group and individual identification, low cost and convenience provided by the present invention.

Thus, what is needed is a disposable luggage wrap, which is easily installed about a piece of luggage, and which is adhesively secured to itself without damage to the luggage. The luggage wrap preferably passes through the luggage handle on the side of the luggage as shown in FIG. 1A, or through the luggage handle and the extendable handle, as shown in FIG. 1B. The luggage wrap assembly provides easy identification of the luggage, and can be personalized with the user's signature or initials, to ensure integrity during transport. The disposable luggage wrap can include indicia relating to identification of a group or organization, which can be very beneficial when traveling together in a group on commercial or private carriers. The bottom surface of the luggage wrap provides a convenient mounting location for securing an R.F.I.D. tag, and preferably includes a pocket for travel information or identification while traveling, which may be accessed without opening the luggage or removal of the disposable luggage wrap. Two or more disposable luggage wraps may be joined end to end to encircle larger luggage. The disposable luggage wrap is attractive, economical, and easy to transport or store until needed.

BRIEF SUMMARY OF THE INVENTION

Accordingly, it is an object of the present invention to provide a disposable luggage wrap that addresses these needs.

It is another object of the present invention to provide a disposable luggage wrap which has a pocket at one end suitable for receiving and transporting identifying indicia therein.

It is still another object of the present invention to provide a tear strip extending across the width of the disposable luggage wrap for ease of removal without requiring a knife, scissors, or other cutting implement.

It is yet another object of the present invention to provide a disposable luggage wrap suitable for use on various sizes of luggage, wherein the disposable luggage wrap is sized to fit beneath the luggage handle and to encircle the luggage and to adhesively secure to itself, to resist removal of the strap from the luggage during transit.

It is still another object of the present invention to provide a disposable luggage wrap for systematically identifying luggage that permits groups of people to distinguish their luggage from that of all other travelers' luggage, while simultaneously identifying each group members' individual luggage.

A disposable strip of non-elastic, tear resistant material is sized to extend around the outer periphery of a piece of luggage to adhesively secure to itself. Indicia representative of a group or organization may be preprinted thereon to identify luggage belonging to the group. Individual identification is also provided thereon, for ease of individual identification. A space may be provided to include the user's signature or initials, to inhibit unauthorized removal and replacement of the disposable luggage wrap during transit. A pocket is preferably located at one end to receive user identification. A tear strip is provided for ease of removal of the luggage wrap. An R.F.I.D. tag may be secured to the underside of the luggage wrap for electronic tracking. The R.F.I.D. tag preferably includes information on the user's identification, the carrier or group identification, and destination information. More than one luggage wrap may be secured end-to-end to encircle larger luggage.

DETAILED DESCRIPTION OF THE INVENTION

Figure 3:
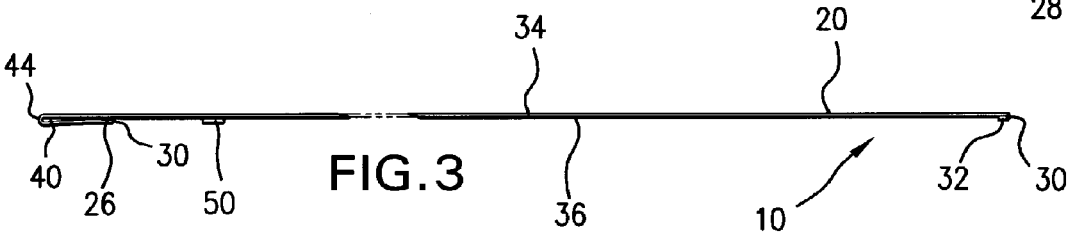
FIG. 3 is a side view of the disposable luggage wrap showing a pocket at one end for receiving transport and/or personalized information, which travels with the luggage, yet is assessable during transit, without removing the disposable luggage wrap.
Figure 4:
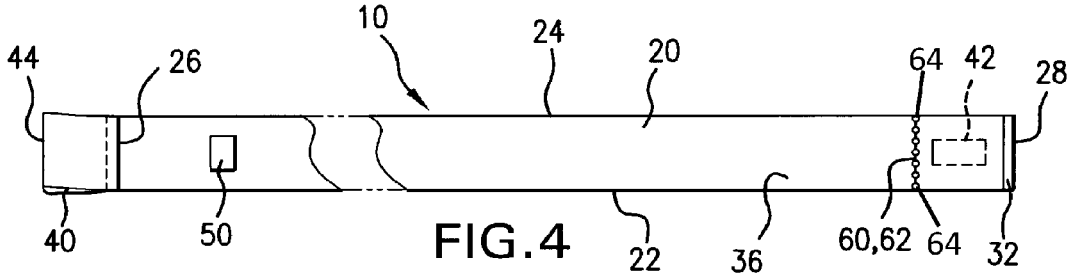
FIG. 4 is a bottom view of the disposable luggage wrap showing the pocket at a first end, and an R.F.I.D. sensor installed on the bottom surface, anywhere along the disposable luggage wrap, to suit user or manufacturing preference.
Figures 5, 6:
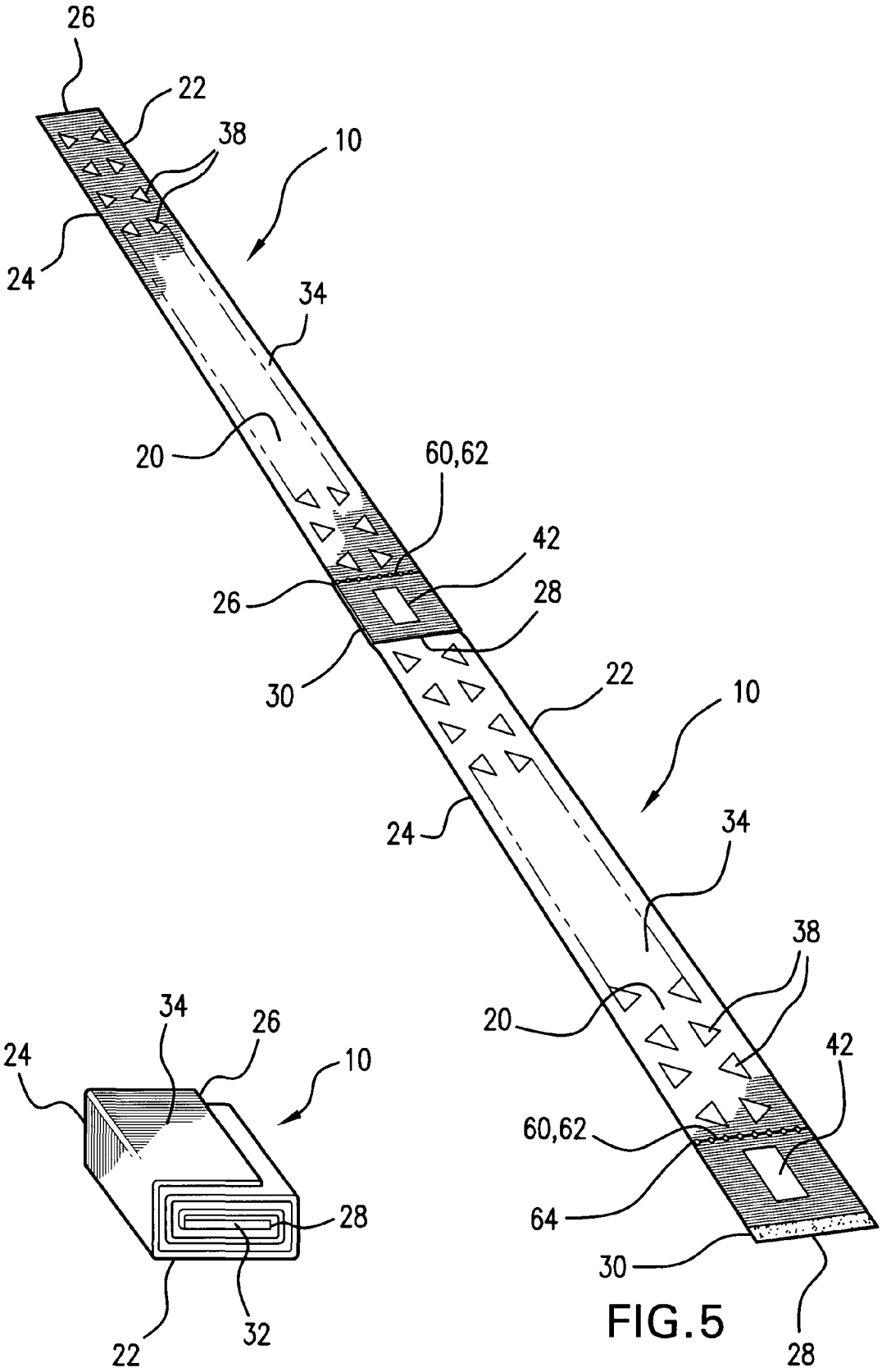
FIG. 5 is a perspective view of two disposable luggage wraps positioned end-to-end to accommodate larger luggage.
FIG. 6 is a perspective view of the disposable luggage wrap folded for transport or storage.

The disposable luggage wrap 10 shown in FIG. 1-6 comprises an elongated, disposable, non-elastic strip 22 of tear resistant flexible material 24, such as a polyethylene film, or the like, and is sized to wrap about a standard sized piece of luggage 12. Where larger luggage is used (not shown), two or more non-elastic strips 22 may be secured end 26 to end 28 to encircle the larger luggage, as shown in FIG. 5.

Figure 1A:
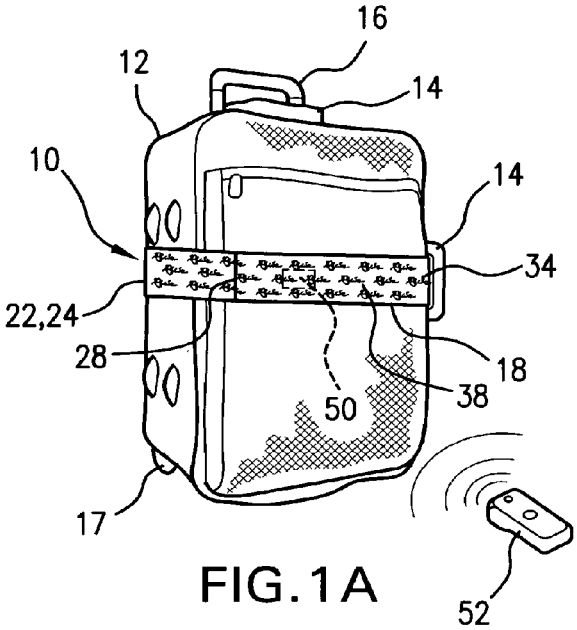
FIG. 1A is a perspective view of the disposable luggage wrap installed horizontally about a piece of luggage.
Figure 1B:
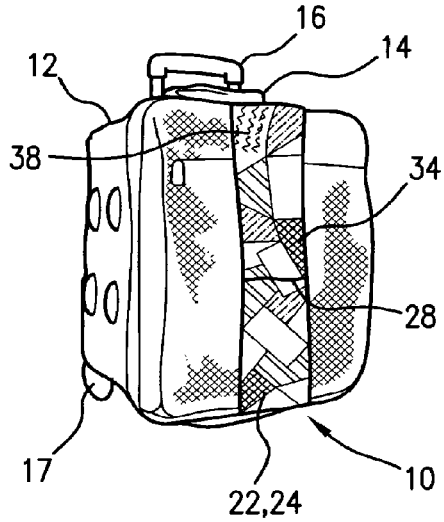
FIG. 1B is a perspective view of the disposable luggage wrap installed vertically about a piece of luggage.

As shown in FIG. 1A and FIG. 1B, the disposable luggage wrap 10 encircles the luggage 12 during use, and may overlap as it is drawn taught to secure to itself to provide for different sized luggage 12. The width of the disposable luggage wrap 10 is preferably sized from about one inch to six inches, to fit beneath the luggage handle 14, and to secure to itself with a suitable adhesive 30 located in proximity to the second end 28 of the luggage wrap 10. The adhesive 30 provides a sufficiently strong bond to mark, damage or tear the disposable luggage wrap 10 during separation or removal.

Once installed about the user's luggage 12, the luggage cannot be opened without marking, damaging or tearing the disposable luggage wrap 10. A suitable signature space 42 is provided on the top surface 34 of the disposable luggage wrap 10. While a signature space 42 is shown in proximity to the second end 28 in FIG. 2, the signature space 42 may be positioned at any selected position along the top or bottom surface along the elongated length of the disposable luggage wrap 10. The signature space 42 is provided for the user to signor initial 20 the disposable luggage wrap 10 prior to installation. If a user's luggage 12 arrives without their signature or initials in the signature space 42 provided, the user is alerted that unauthorized access to their luggage 12 has occurred during transit, and the authorities may immediately be notified. If the luggage 12 arrives safely during transit, with the disposable luggage wrap 10 installed on the luggage 12 and the signature space 42 signed or initialed by the user, but subsequently arrives at the place of lodging with the luggage wrap 10 marked, damaged, torn or removed, then the user knows when the damage occurred, and thus may take appropriate action. This greatly helps to eliminate false claims.

As shown in FIG. 1A and FIG. 1B, the first end 26 of the disposable luggage wrap 10 is preferably placed in proximity to the luggage handle 14, and the second end 28 of the luggage wrap 10 is wrapped about the luggage 12 to encircle the luggage 12, and is drawn tight and sealed to the top surface 34 of the luggage wrap 10 with a suitable adhesive 30 at assembly. Note that the disposable luggage wrap 10 is sized to pass through the luggage handle 14 as shown in FIG. 1A, or through the luggage handle 14 and the extendable handle 16 (when used) as shown in FIG. 1B. This ensures that the disposable luggage wrap 10 cannot be easily removed, without marking, damaging, or tearing the disposable luggage wrap 10. The disposable luggage wrap may further serve to cover the zipper tabs (not shown) when moved beneath the handle, to discourage unauthorized tampering with the user's luggage, while leaving the luggage open for inspection by proper authorities.

Figure 2:
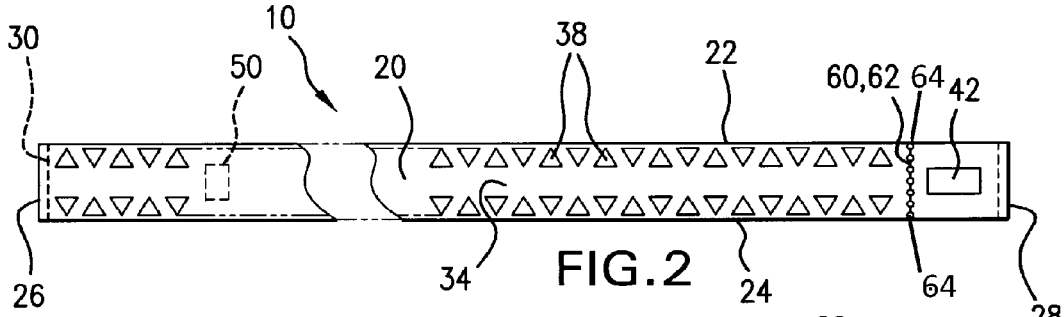
FIG. 2 is a top perspective view of the disposable luggage wrap prior to installation about a piece of luggage. Note the tear strip may be located anywhere along the disposable luggage wrap.

FIG. 2 is a top view of the top portion 34 of the luggage wrap 10 prior to assembly. Note the indicia 38 on the top portion of the disposable luggage wrap 10, which serves to identify a group or organization traveling together on a commercial carrier, such as a boat, plane, train, bus or other public or private transport. The indicia 38 may be an image, picture, design, trademark, logo, brand name, slogan, advertisement, etc. in one or more colors which is preferably repeated to form a distinctive pattern thereon. Texture (not shown) may also be used on the disposable luggage wrap 10, to aid identification by the visually impaired. The indicia 38 is intended to easily identify multiple pieces of luggage 12 used by multiple users while traveling as a group or organization, and is very helpful in identifying luggage 12 that has been misrouted or misplaced in transit. The disposable luggage wrap 10 is lightweight, inexpensive, attractive, and provides a means to identify the user's luggage 12, as well as the collective luggage of a group or organization when traveling together.

Also note a plurality of closely spaced in-line apertures 62 extending across the width of the disposable luggage wrap 10 from the first side 22 to the second side 24. The apertures 62 may be any shape or size to suit their intended purpose. The spacing between the in-line apertures 62 is selected to ensure that a reasonable force is required to intentionally tear the disposable luggage wrap 10 from the luggage, for ease of removal. A notch 64 may be provided at one or both edges 22,24 of the disposable luggage wrap 10 to reduce the force needed to tear the disposable luggage wrap 10. A tear strip 60 may be positioned along the plurality of closely spaced, in-line apertures 62. The tear strip 60 provides leverage to sever the space between the in-line apertures 62 when the tear strip 60 is pulled to remove the luggage wrap 10 from the luggage 12. This eliminates the need for the user to locate a knife or scissors, which cannot be carried by the user in their carry-on baggage when traveling by plane. The tear strip 60 with the plurality of in-line apertures 62 may be positioned across the width of the luggage wrap 10 to extend from the notch 64 at the first side 22 to the notch 64 at the second side 24. The tear strip 60 may be positioned at any selected location along the length of the disposable luggage wrap 10, but is preferably positioned in proximity to the second end 28, for ease of location during use.

As shown in FIG. 2, the disposable luggage wrap 10 also preferably provides a space 42 for signature or initials on the top or bottom surface 34, 36 of the disposable luggage wrap 10, at a convenient location. When placed on the bottom surface 36, the signature or initials are not observable until the luggage wrap 10 is removed from the luggage 12. The signature or initials ensure that the luggage 12 has not been opened during transit, and serve to alert the user when the disposable luggage wrap 10 has been marked, damaged or replaced during transit. The space 42 for signature or initials may be located on the top or bottom surface 34, 36 along the length of the disposable luggage wrap 10 to suit user or manufacturing preference.

FIG. 3 is a side view of the disposable luggage wrap 10, showing the adhesive 30 and peelable adhesive cover 32 extending across the width of the luggage wrap 10, from the first side 22 to the second side 24, in proximity to the second end 28.

Also shown in FIG. 3, an optional pocket 40 is provided near the first end 26 of the disposable luggage wrap 10. The pocket 40 provides a convenient location to place the user's travel itinerary and user identification therein. Upon retrieval of the luggage 12 from one transport carrier, the user may remove information from the pocket 40 regarding their recent arrival, and insert new information about their next leg of the journey, such as a hotel, stateroom, etc. This may be done prior to opening the luggage 12. This ensures that the luggage 12 is not tampered with between the user's recent arrival and delivery of the luggage 12 to the user's stateroom or hotel room.

The pocket 40 is created by a fold line 44 formed when the first end 26 of the disposable luggage wrap 10 is folded over, and the first end 26 is secured to either the top surface 34 or bottom surface 36 of the luggage wrap 10. The length of the pocket 40 may be any suitable length to accommodate the information to be stored therein. The pocket 40 may alternately be secured along one of the first side 22 or the second side 24 and along the first end 26 of the disposable luggage wrap 10, to form a three sided pocket 40 therebetween. Alternately, the pocket 40 may be formed between the fold line 44 and the first end 26 of the disposable luggage wrap 10, to form a two sided pocket 40, to suit user or manufacturing preference. See FIG. 3 and FIG. 4. The pocket may be secured by any known means, such as with adhesive, by sewing, heat sealing, etc.

Because the disposable luggage wrap 10 is inexpensive, lightweight, and may be folded or rolled up for transport or storage, as shown in FIG. 6, several disposable luggage wraps 10 may be placed in the user's luggage 12, while traveling, and used for each leg of a journey, to ensure safety and integrity while traveling. Preferably, a separate luggage wrap 10 is used, each time the luggage 12 is accessed while traveling.

FIG. 4 is a bottom view of the disposable luggage wrap 10 prior to installation about a piece of luggage 12. Note the location of a pocket 40 at the first end 26, and the location of the adhesive 30 and removable adhesive cover 32 at the second end 28. The optional pocket 40 is preferably located at either the first end 26 or the second end 28, to suit user or manufacturing preference.

Also note the use of an R.F.I.D tag 50. For purposes of this disclosure, the R.F.I.D. tag may be also called a sensor. The R.F.I.D. tag is preferably positioned and secured to the bottom surface 36 of the disposable luggage wrap 10, in proximity to the first end 26. Alternately, the R.F.I.D. tag may be positioned and secured at any position along the underside of the disposable luggage wrap 10 to suit manufacturing preference. The R.F.I.D. tag 50 provides electronic tracking for rapid location and identification of a piece of luggage 12 while in transit when in proximity to a remote R.F.I.D. reader 52. The remote R.F.I.D. reader 52 may be hand held, or remotely located, and can be used to identify the location of a piece of luggage 12. The remote R.F.I.D. reader 52 is well known in the art, and thus not further disclosed herein. At least one R.F.I.D. tag 50 preferably includes information on at least two of the following: the user's identification, the trip itinerary, carrier identification, group identification, departure information and the user's destination information.

For example, if a piece of luggage is misplaced, it may be easily located in a room full of misplaced luggage by quickly scanning the luggage 12 with a remote R.F.I.D. reader 52 to identify the location of the R.F.I.D. tag 50. Likewise, when the luggage 12 is placed upon a conveyor in a busy terminal, the R.F.I.D. tag 50 may be used to easily identify the user's luggage 12, as the luggage 12 passes in proximity to a hand held or remotely positioned R.F.I.D. reader 52. The R.F.I.D. tag 50 may also be used to aid a vision impaired user to find their luggage 12 in a busy terminal or other destination. Group identification is also preferably provided so that the luggage belonging to a group of travelers or a commercial carrier, such as a ship, bus or plane, may be easily identified during transit. This is especially valuable when a group travels to multiple destinations on multiple carriers, such as airplanes, busses and ships, and stays at multiple hotels or motels at multiple destinations during the journey.

FIG. 5 is a top view of the disposable luggage wrap 10, where two or more disposable luggage wraps 10 may be secured together end-to-end to encircle the outer periphery of a larger size of luggage 12. The second end 28 of a first disposable luggage wrap 10 is secured to the first end 26 of a second luggage wrap 10 using the adhesive 30 provided. The end-to-end luggage wraps 10, 10 are then placed about larger luggage (not shown), and drawn tight, and secured together with the adhesive 30 located on the second end 28 of the second luggage wrap 10.

At assembly, the disposable luggage wrap 10 is placed around a piece of luggage 12 with the first end 26 preferably placed in proximity to the luggage handle 14 as shown in FIG. 1A or beneath the luggage handle 14 and the extendable handle 16 (when used), as shown in FIG. 1B. The second end 28 of the luggage wrap 10 is then wrapped around the outer periphery 18 of the luggage 12 until it encircles the luggage 12. The disposable luggage wrap 10 is then drawn tight. The adhesive cover 32 is then removed, and the adhesive 30 is placed directly against the top surface 34 of the disposable luggage wrap 10, effectively securing the disposable luggage wrap 10 about the luggage 12, without damage to the outer surface of the luggage 12. This places the disposable luggage wrap 10 beneath the luggage handle 14, and beneath the extendable handle 16, which keeps the disposable luggage wrap 10 from slipping or being slid off the luggage 12 during transport.

The luggage 12 cannot be opened while the disposable luggage wrap 10 is in place about the luggage 12. Some luggage 12 includes a first handle 14 at the top of the luggage, and a second handle 14 at one side of the luggage 12. Some luggage 12 also includes wheels 17 at the bottom or one side of the luggage. The disposable luggage wrap 10 may be wrapped about the luggage 12 between the wheels 17 and the handle 14 located opposite the wheels 17, as shown in FIG. 1B. Alternately, the disposable luggage wrap 10 may be wrapped about the luggage and extend between the handle 14, as shown in FIG. 1A. Of course, more than one luggage wrap 10 may be used to secure a piece of luggage 12 for transport or storage.

While the present invention has been illustrated in conjunction with a detailed description of the preferred invention, it will be obvious to those skilled in this art that various changes in form and detail can be made without departing from the scope of this invention, or from the following claims.

DISPOSABLE LUGGAGE WRAP PARTS LIST

10—disposable luggage wrap
12—luggage
14—luggage handle
16—extendable handle
17—wheel(s)
18—outer periphery
20—flexible, non-elastic, tear resistant material
22—first side
24—second side
26—first end
28—second end
30—suitable adhesive
32—peelable adhesive cover
34—top surface
36—bottom surface
38—indicia
40—pocket
42—signature space
44—fold line
50—R.F.I.D. tag or sensor
52—R.F.I.D. reader
60—tear strip
62—plurality of closely spaced in-line apertures

What is claimed is:

1. A disposable luggage wrap assembly for securing an existing piece of luggage from unauthorized entry during transit, comprising:

a luggage wrap formed of substantially tear resistant material that is sized to extend through a handle portion of the existing piece of luggage, the luggage wrap having a length and flexibility to wrap about an outer periphery of said luggage, the luggage wrap having a top surface, a bottom surface, a first side, a second side, a first end and a second end;

an adhesive located on the bottom surface of the luggage wrap in proximity to the second end and extending substantially from the first side to the second side of the luggage wrap, the adhesive being securable to the top surface of the luggage wrap to form an adjustable loop that is sized by providing an overlap between a portion of the top surface proximate to the first end and a portion of the bottom surface proximate to the second end;

a signature space provided at least on one of the top and bottom surfaces of the luggage wrap, the signature space being of sufficient size to receive at least one of a signature and initials; and a second disposable luggage wrap that is secured end-to-end to the luggage wrap to encircle the outer periphery of a large-sized piece of luggage, wherein the second end of the luggage wrap is secured by the adhesive to a first end of the second luggage wrap.

2. The disposable luggage wrap assembly of claim 1, further comprising an R.F.I.D. tag that enables electronic tracking.

3. The disposable luggage wrap assembly of claim 2, wherein the R.F.I.D. tag includes at least one of user identification information, trip itinerary information, carrier identification information, group identification information, departure information, and destination information.

4. The disposable luggage wrap assembly of claim 1, further comprising a pocket disposed on at least one of said top and bottom surfaces of the luggage wrap, said pocket being sized to hold at least one of traveling papers, destination papers, hotel information, motel and stateroom papers, and user identification papers.

5. The disposable luggage wrap assembly of claim 1, further comprising a plurality of closely spaced in-line apertures that extend across the width of the luggage wrap, the spacing between the apertures being selected to facilitate tearing the luggage wrap without using a cutting implement.

6. The disposable luggage wrap assembly of claim 5, further comprising a tear strip provided in proximity to the plurality of apertures, the tear strip being provided to be pulled for ease of removal of the disposable luggage wrap.

7. The disposable luggage wrap assembly of claim 1, further comprising an indicia pattern disposed on the top surface of said luggage wrap, the indicia pattern extending substantially over the length of the luggage wrap and providing a distinctive pattern, wherein the indicia pattern includes at least one of an image, color, picture, design, trademark, logo, brand name, slogan, and advertisement.

8. The disposable luggage wrap assembly of claim 1, wherein the luggage wrap is made from polyethylene film.

9. A disposable luggage wrap assembly for securing an existing piece of luggage from unauthorized entry during transit, comprising:

a luggage wrap formed of substantially tear resistant material that is sized to extend through a handle portion of the existing piece of luggage, the luggage wrap having a length and flexibility to wrap about an outer periphery of said luggage, said luggage wrap having a top surface, a bottom surface, a first side, a second side, a first end and a second end;

an adhesive located on the bottom surface of the luggage wrap in proximity to the second end and extending substantially from the first side to the second side of the luggage wrap, the adhesive being securable to the top surface of the luggage wrap to form an adjustable loop that is sized by providing an overlap between a portion of the top surface proximate to the first end and a portion of the bottom surface proximate to the second end;

a signature space positioned at least on one of the top and bottom surfaces of the luggage wrap, the signature space being of sufficient size to receive at least one of a signature and initials;

a R.F.I.D. tag secured to the luggage wrap to provide electronic tracking; and a second disposable luggage wrap that is secured end-to-end to the luggage wrap to encircle the outer periphery of a large-sized piece of luggage, wherein one of the first end and the second end of the luggage wrap is adhesively secured to one of the first end and the second end of the second luggage wrap.

10. The disposable luggage wrap assembly of claim 9, wherein the R.F.I.D. tag includes at least one of user identification information, trip itinerary information, carrier identification information, group identification information, departure information, and destination information.

11. The disposable luggage wrap assembly of claim 9, further comprising a pocket disposed on at least one of the top and bottom surfaces of the luggage wrap, said pocket being sized to hold at least one of traveling papers; destination papers; hotel information, motel and stateroom papers, and user identification papers.

12. The disposable luggage wrap assembly of claim 9, further comprising a plurality of closely spaced in-line apertures that extend across the width of the luggage wrap between the first side and the second side, the spacing between the apertures being selected to facilitate tearing the luggage wrap without using a cutting implement.

13. The disposable luggage wrap assembly of claim 12, further comprising a tear strip provided in proximity to the plurality of apertures, the tear strip being provided to be pulled for ease of removal of the disposable luggage wrap.

14. The disposable luggage wrap assembly of claim 9, further comprising an indicia pattern disposed on the top surface of said luggage wrap, the indicia pattern extending substantially over the length of the luggage wrap and providing a distinctive pattern, wherein the indicia pattern includes at least one of an image, color, picture, design, trademark, logo, brand name, slogan, and advertisement.

15. A disposable luggage wrap assembly for securing an existing piece of luggage from unauthorized entry during transit, comprising:

a luggage wrap sized to extend through a handle portion of the existing piece of luggage, the luggage wrap having a length and flexibility to wrap about an outer periphery of said luggage, the luggage wrap having a top surface, a bottom surface, a first side, a second side, a first end and a second end;

an adhesive located on the bottom surface of the disposable luggage wrap in proximity to the second end of the luggage wrap and extending substantially from the first side to the second side of the luggage wrap, the adhesive being securable to the top surface of the luggage wrap to form an adjustable loop that is sized by providing an overlap between a portion of the top surface proximate to the first end and a portion of the bottom surface proximate to the second end;

a plurality of closely spaced in-line apertures positioned to extend across the width of the luggage wrap, the spacing between the apertures being selected to facilitate tearing the luggage wrap without a cutting implement; and a second disposable luggage wrap that is secured end-to-end to the luggage wrap to encircle the outer periphery of a large-sized piece of luggage, wherein one of the first end and the second end of the luggage wrap is adhesively secured to one of the first end and the second end of the second luggage wrap.

16. The disposable luggage wrap assembly of claim 15, further comprising a tear strip provided in proximity to the plurality of apertures, the tear strip being provided to be pulled for ease of removal of the disposable luggage wrap.

17. The disposable luggage wrap assembly of claim 15, further comprising a R.F.I.D. tag that enables electronic tracking and wherein said R.F.I.D. tag includes at least one of user identification information, trip itinerary information, carrier identification information, group identification information, departure information, and destination information.

18. The disposable luggage wrap assembly of claim 15, further comprising a pocket disposed on at least one of the top and bottom surfaces of the luggage wrap, the pocket being sized to hold at least one of traveling papers, destination papers, hotel information, motel and stateroom papers, and user identification papers.

* * * * *